United States Patent [19]

Nguyen

[11] Patent Number: 4,796,772

[45] Date of Patent: Jan. 10, 1989

[54] METAL CLOSURE WITH CIRCUMFERENTIALLY-VARIEGATED STRENGTHENING

[75] Inventor: Tuan A. Nguyen, Thornton, Colo.

[73] Assignee: Ball Corporation, Muncie, Ind.

[21] Appl. No.: 183,498

[22] Filed: Apr. 14, 1988

Related U.S. Application Data

[63] Continuation of Ser. No. 91,690, Sep. 7, 1987, abandoned.

[51] Int. Cl.[4] ..... B65D 8/08

[52] U.S. Cl. ..... 220/66; 220/62; 413/8

[58] Field of Search ..... 220/66, 67, 268–270; 413/8; 72/354, 372, 379

[56] References Cited

U.S. PATENT DOCUMENTS

| | | | |
|---|---|---|---|
| 3,441,170 | 4/1969 | Khoury . | |
| 4,448,322 | 5/1984 | Kraska | 220/67 |
| 4,467,933 | 8/1984 | Wilkinson et al. | 220/66 |
| 4,577,774 | 3/1986 | Nguyen | 220/66 |
| 4,606,472 | 8/1986 | Tauhe et al. | 220/66 |
| 4,641,761 | 2/1987 | Smith et al. | 220/66 |
| 4,655,358 | 4/1987 | Kaffko | 220/66 |

*Primary Examiner*—George T. Hall
*Attorney, Agent, or Firm*—Gilbert E. Alberding

[57] ABSTRACT

A metal closure for beverage containers of the type having a center panel, a center-panel ring, an inner leg, and a pull-tab opener, includes circumferential variegations for increasing the buckling pressure of the container. The circumferential variegations are cold-worked or coined into the center-panel ring and/or into portions of the closure that are adjacent to the center-panel ring. The circumferential variegations include coined surfaces with variegated lengths, variegated coin angles, variegated coin residuals, variegated spaces between coined surfaces, or variegated widths of the center panel. The circumferential variegations achieve non-axisymmetric doming of the metal closure and increase the buckling pressure of the closure by obviating excess metal in the center panel that typically results from scorning the center panel for the easy open end.

53 Claims, 2 Drawing Sheets

METAL CLOSURE WITH CIRCUMFERENTIALLY-VARIEGATED STRENGTHENING

This is a continuation of application Ser. No. 091,690, filed Sept. 1, 1987, now abandoned.

BACKGROUND OF THE INVENTION

1. Field of the Invention

The present invention relates to closures for metal beverage containers. More particularly the present invention relates to container closures having increased strength.

2. Description of the Prior Art

Metal beverage containers ae a very competitive product in the packaging industry since the annual production of these containers is well over 70 billion per year in the United States alone. Even a small reduction in the thickness of the metal used in the container closure can result in savings of millions of dollars annually.

The closures for the containers typically include a center panel that is generally planar but domed upwardly, a center-panel ring that is disposed annularly around the center panel and that curves downwardly therefrom, an inner leg that projects donwardly from the center-panel ring, a curved connecting portion that connects to the inner leg distal from the center-panel ring, an outer leg that connects to the curved connecting portion and that extends upwardly, and an outer curl that is used for double seaming to the container.

One of the limitations in the strength of a container of this type is the internal pressure at which buckling of the closure occurs. Buckling refers to a permanent and objectionable deformation of the closure, including the inner leg, the outer leg, and the center panel, in which circular uniformity of the closure is destroyed by fluid pressure that is exerted inside the closure.

Various attempts have been made to increase the buckling pressure of container closures; and these attempts are represented by issued patents which are discussed below.

Gedde, in U.S. Pat. No. 3,774,801, teaches complex doming of the center panel that includes a plurality of circumferentially-uniform steps as a method of increasing the buckling pressure of the closure.

Khoury, in U.S. Pat. No. 3,441,170, teaches coining of the inside of the center-panel ring as a method of allowing the center panel to dome under pressure without the doming exerting a full buckling force on the inner and outer legs of the closure. The inventor states that the coined area functions as a hinge.

Jordan, in U.S. Pat. No. 4,031,837, teaches increasing the buckling pressure by reforming the closure with a reduced radius in the curved-connecting portion that interconnects the inner and outer legs, by increasing the angle of the inner leg to substantially vertical, and by moving the curved-connecting portion downwardly from the center panel.

Kraska, in U.S. Pat. Nos. 4,217,843 and 4,448,322, teaches a reforming operation in whch the outer leg is positioned more nearly vertical, the inside radius of the center-panel ring is reduced, and the inside radius of the center-panel ring is coined to produce doming of the center panel.

Some doming of the center panel has been found to increase the buckling pressure of the containers because it eliminates any excess metal that results from scoring for opening. The presence of excess metal allows an uneven distribution of stress in the center panel, so that buckling results at lower internal pressures.

The prior art includes U.S. Pat. Nos. 4,434,641 and 4,577,774, both of common ownership to the present invention. In these patents, Nguyen teaches coining the convex outside surface of the center-panel ring to increase the buckling pressure of the container closures.

The prior art also includes patent application Ser. No. 06/075,384 of common ownership to the present invention. This patent application teaches increasing the buckling pressure of container closures by double coining, or by curvilinear coining, the convex outer surface of the center-panel ring and/or portions of the center panel or the inner leg.

Coining is a local deformation, by cold-working, of metal by reduction of thickness in a specified and limited, or predetermined, area through a mechanical pressing operation. Cold-working may, or may not, include a reduction in material thickness; but coining always includes a reduction in thickness of some localized area of the material, even through this reduction in thickness may be slight.

Coining a container closure produces compression doming of the center panel. Optionally, this doming can be limited by providing a hold-down pad, as taught by Nguyen in the aforesaid prior art patents.

SUMMARY OF THE INVENTION

In the present invention, improved strength is provided in a container closure of the type which includes a center panel being disposed orthogonal to a container axis and having an outer perimeter, a center-panel ring being disposed perimetrically around the center panel and bending downwardly, an inner leg that extends downwardly from the center-panel ring, a connecting portion tha curves upwardly and that includes a concave radius on the public side of the closure, an outer leg that extends upwardly from the connecting portion, and an outer curl that curls outwardly and downwardly and that is used for double seaming the closure to the sidewall of a container.

The container closure includes circumferential variegations that increase the buckling pressure of the closure. The circumferential variegations may be in the shape and/or width of the center-panel ring, as formed. The circumferntial variegations may be formed by cold-working portions of the center-panel ring and/or portions of the closure that are adjacent to the center-panel ring. Or, the circumferential variegations may be formed by coining portions of the center-panel ring, and/or portions of the closure that are adjacent to the center panel ring, to reduced thicknesses.

By selecting various parameters of the circumferential variegations, extra metal in the center panel, as caused by scoring for the pull-tab opener, can be domed selectively, thereby preventing this extra metal from causing uneven distribution of stress on the inner and outer legs when the container is subjected to internal fluid pressure, and thereby increasing the buckling pressure of the container closure.

Thus, by providing circumferential variegations, the doming that results does not necessarily produce a surface of revolution that is axisymmetrical with the container axis. Instead, the doming that is achieved by the present invention may be selectively shaped to curve up more rapidly from the inner leg at one circumferential location than at another.

It is important to limit the height of doming to prevent detrimentally reducing the rock pressure of the containers, and to prevent accidental opening of containers due to the tab engaging relatively moving surfaces during automatic handling of the containers.

It is believed that this circumferentially-variegated strengthening, and selectively-shaped doming will provide an increase in buckling pressure while, at the same time, limiting the height of the doming that is required to achieve a given increase in buckling pressure.

One of the limitations of single coining the center-panel rings as taught by Nguyen has been that the buckling pressure increases as a function of decreases in the coin residual up to the point where further decreases in the coin residual may cause center-panel ring fracture.

Buckling pressures of container closures have been increased, above that which is achieved by single coining, by double coining, and/or curvilinear coining, as taught by the aforesaid patent application.

It is believed that further increases in buckling pressures are obtainable by utilizing the principles of double coining, and/or curvilinear coining, in cooperation with circumferentially-variegated strengthening as taught herein.

It is a principal object of the present invention to increase the buckling pressure that can be achieved in a container closure using a given thickness of metal, or alternately, to achieve the same buckling pressure with a thinner material.

It is an object of the present invention to provide a container closure with circumferentially-variegated strengthening.

It is an object of the present invention to provide strengthening for a container closure, which strengthening includes a circumferentially-variegated cross-section.

It is an object of the present invention to provide a container closure in which the center-panel ring is variegated in width or shape of surface as the container closure is formed.

It is an object of the present invention to form circumferential variegations in the closure as an additional step in a process.

It is an object of the present invention to provide strengthening of a container by coining to circumferentially-variegated thickness and/or coin angles.

It is an object of the present invention to provide non-axial doming by forming circumferential variegations.

Finally, it is an object of the present invention to achieve a maximum increase in buckling pressure while maximizing coin residual and minimizing loss in rock pressure, by axisymmetrical doming of the container closure.

These and other objects of the present invention will become apparent by studying the detailed description, drawings, and claims that are appended hereto.

DESCRIPTION OF THE PREFERRED EMBODIMENT

Figure 1:
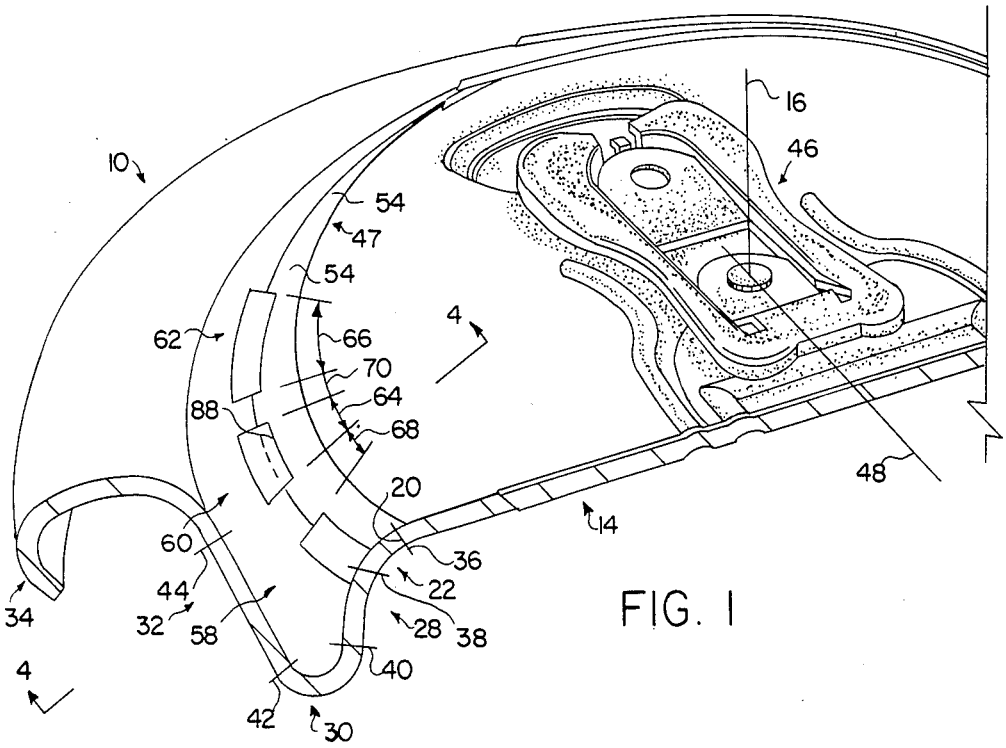
FIG. 1 is perspective view of a first embodiment of the present invention in which the variegated strengthening comprises segmented coining that is overlapped over circumferential coining.
Figure 2:
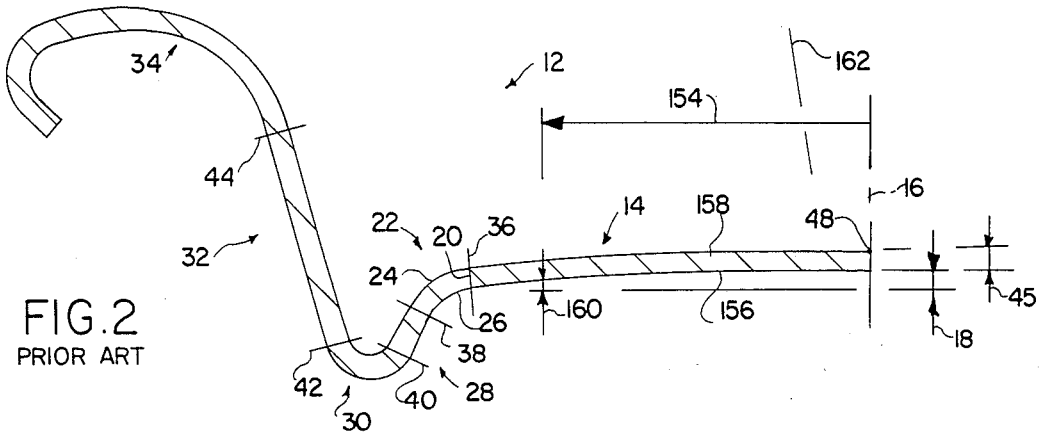
FIG. 2 PRIOR ART
FIG. 2 is an enlarged and partial cross sectional elevation of a shell for forming a container closure, as taught by the prior art, and as reworked into one of the embodiments of the present invention.

Referring now to the drawings, a container closure, or a metal closure 10, which is a first embodiment of the present invention, is shown in FIG. 1, and a cross section of a shell 12 that is typical of the prior art and that can be reworked into any of the embodiments of the present invention is shown in FIG. 2.

The shell 12 includes a center panel or inner portion 14 that is disposed perimetrically around a container axis 16, that is domed to a maximum height 18, and that includes a perimeter 20. A center-panel ring or connecting portion 22 includes a convex outer surface 24 and a concave inner surface 26 and is integral with the center panel 14. An inner leg or outer portion 28 is integrally joined to the center-panel ring 22, a concavely-curved portion 30 is integrally joined to the inner leg 28, an outer leg 32 is integrally joined to the concavely-curved portion 30, and an outer curl 34 is integrally joined to the outer leg 32.

The various portions of the shell 12, as described above, and the locations wherein they join adjacent portions, are defined by lines 36, 38, 40, 42, and 44; and all of the various portions have an uncoined thickness, or stock thickness, 45.

The container closure 10, and other container closures of the present invention which will be described subsequently, include most of the above-described parts and are like-named and like-numbered.

Also typical to the prior art, but illustrated only in FIG. 1, is a pull-tab opener or pull tab 46 that is disposed generally along a pull-tab axis 48 which orthogonally intercepts the container axis 16.

Figure 3:
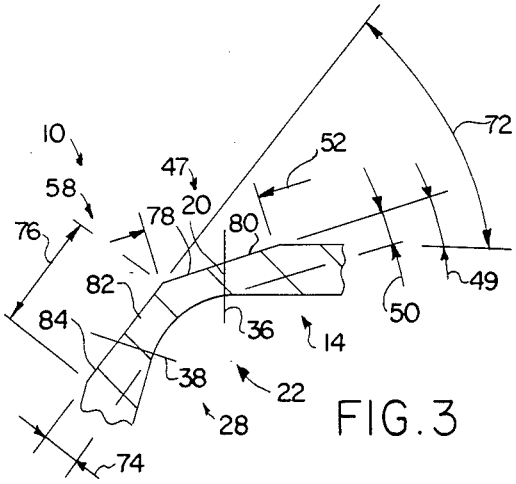
FIG. 3 is an enlarged cross section of a portion of the embodiment of FIG. 1, taken substantially the same as the cross section of FIG. 1, and showing both the circumferential coining and one of the coined segments in cross section.
Figure 4:
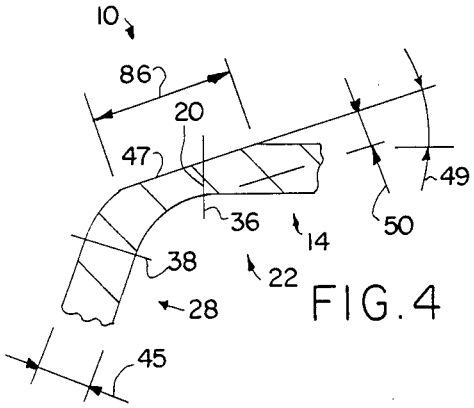
FIG. 4 is an enlarged cross section of a portion of the embodiment of FIG. 1, taken substatially as shown by Section Line 4—4, and showing the circumferential coining between two of the coined segments.

Referring now to FIGS. 1, 3, and 4, and a first embodiment of the present invention, the container closure 10 includes a circumferentially-coined surface 47 that is coined at a first coin angle 49, that produces a first coin residual 50, that has a first coined width 52, and that has a first total coined area 54.

The container closure 10 includes segmented coining that includes coined segments 58, 60, and 62, and equal-length, and like-spaced, coined segments, not shown, which are symmetrically disposed across the pull-tab axis 48.

The coined segments 58 and 60 are of a first arcuate length 64, and the coined segment 62 is of a second and larger arcuate length 66. The coined segments 58 and 60 are spaced-apart by a first circumferential distance 68 and the coined segments 60 and 62 are spaced-apart by a second and smaller circumferential distance 70.

As shown in FIG. 3, the coined segment 58 is coined at a second and larger coin angle 72 than the coin angle 49, produces a second coin residual 74, and has a second coined width 76.

Obviously, the combined total area of the coined segments 58, 60, and 62, is the total of the separate coined areas.

In the embodiment shown, the coin angles of the coined segments 60 and 62 are the same as the coin angle 72 of the coined segment 58, but the present invention envisions using different coin angles for various coined segments. Further, in the embodiment shown, the coin angle 49 for the circumferentially-coined surface 47 is circumferentially uniform, but the present invention envisions achieving circumferential variegations by varying the coin angle 49 at selected circumferential locations. For instance, to achieve circumferential variegations, the coin angle 49 could circumferentially vary up to the coin angle 72, and the segments 58, 60, and 62 might be omitted.

As seen in FIG. 3, the circumferentially-coined surface 47 includes a portion 78 of the center-panel ring 22 and a portion 80 of the center panel 14. In like manner, the coined segment 58 includes a portion 82 of the center panel ring 22 and a portion 84 of the inner leg 28.

Referring now to FIGS. 1 and 4, the circumferentially-coined surface 47 includes a single-coined width 86 that is wider than the first coined width 52 of FIG. 3. As seen in FIG. 1, the single-coined width 86 is double-coined in spaced circumferential locations to the coined width 52 by the segments 58, 60, and 62. This double-coining produces a plurality of double-coined areas that are circumferentially-spaced, such as a double coined area 88 which is shown by a phantom line in FIG. 1.

Figure 5:
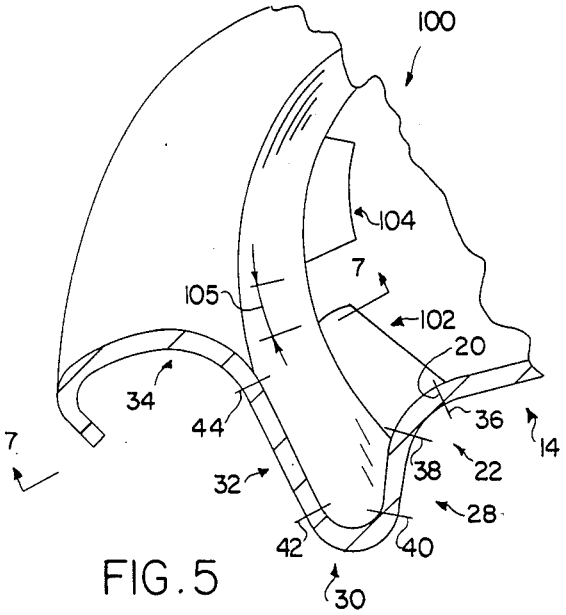
FIG. 5 is a partial perspective view of a second embodiment of the present invention in which the variegated strengthening comprises curvilinear coining that is segmented and that includes variegated coining radii.
Figure 6:
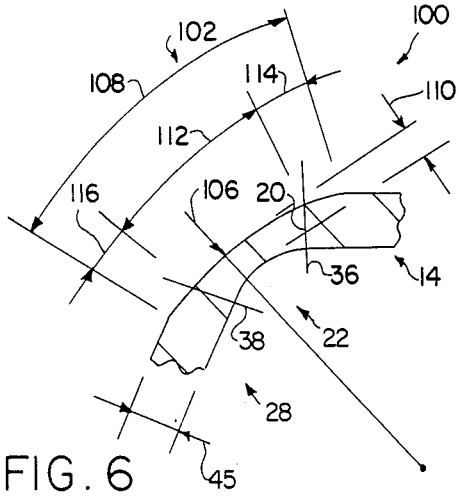
FIG. 6 is an enlarged cross sectional view of the embodiment of FIG. 5, taken substantially the same as the cross section of FIG. 5, and showing a first and smaller radius of curvilinear coining.
Figure 7:
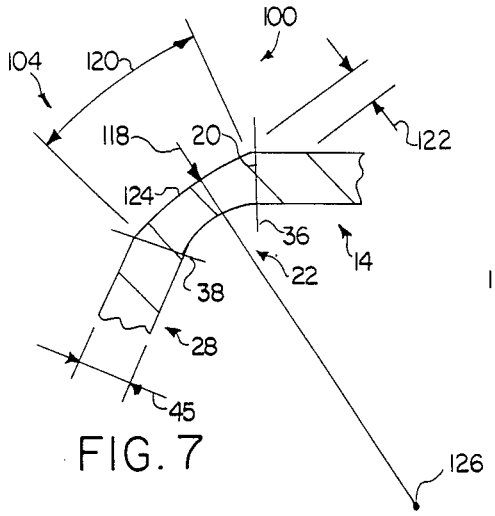
FIG. 7 is an enlarged cross sectional view of the second embodiment of FIG. 5, taken substantially as shown by Section Line 7—7 of FIG. 5, and showing a second and larger radius of curvilinear coining.

Referring now to FIGS. 5–7, a container closure, or metal closure, 100 includes like-named and like-numbered parts as given in conjunction with the shell 12 of FIG. 2.

The circumferentially-variegated strengthening of the container closure 100 includes curvilinearly-coined segments 102 and 104 that are spaced apart by a circumferential distance 105.

At the cross section which is illustrated in FIGS. 5 and 6, the curvilinearly-coined segment 102 is coined with a first coin radius 106, has a first coined width 108, produces a first coin residual 110, includes a portion 112 of the center-panel ring 22, includes a portion 114 of the center panel 14, and includes a portion 116 of the inner leg 28.

In contrast, at the circumferential location which is illustrated in FIG. 7, the curvilinearly-coined segment 102 is coined with a second and larger coin radius 118, has a second and smaller coined width 120, produces a second coin residual 122, includes a portion 124 of the center-panel ring 22, but does not include any of the center panel 14 or the inner leg 28. However, by inspection, it can be seen that portions of the center panel 14, or of the inner leg 28, could be included by changing the radius 118, by moving a center 126 of the radius 118, and/or by coining to a curvilinear contour that is not at a constant radius about a center.

Figure 8:
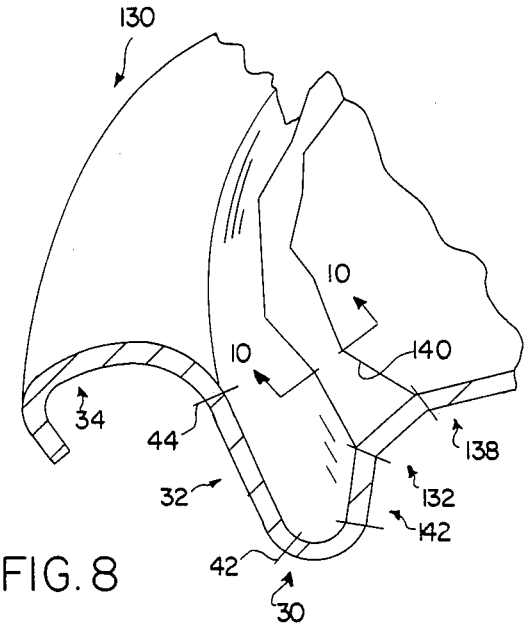
FIG. 8 is a partial perspective view of a third embodiment of the present invention in which the variegated strengthening comprises a variegated width of the center-panel ring.
Figure 9:
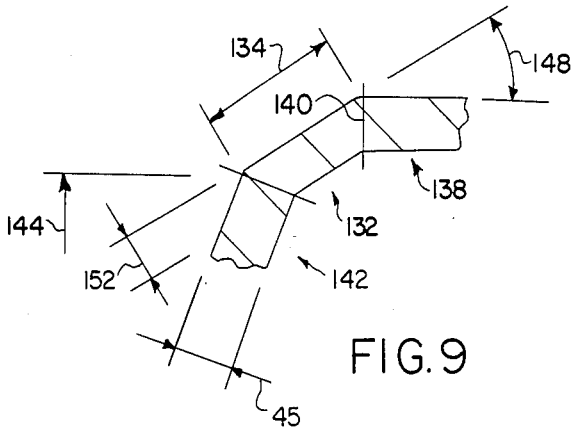
FIG. 9 is an enlarged cross sectional view of the embodiment of FIG. 8, taken substantially the same as the cross section of FIG. 8, and showing a first and wider width of the center-panel ring.
Figure 10:
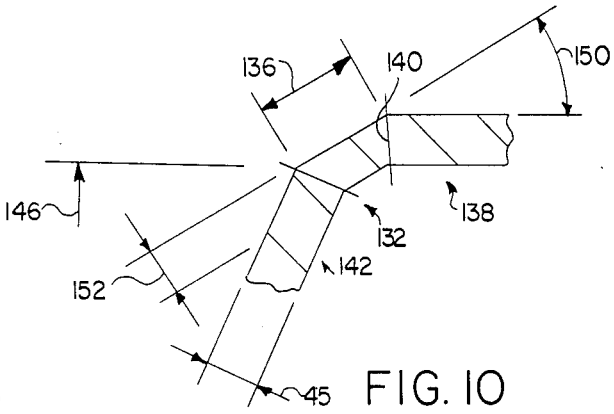
FIG. 10 is an enlarged cross sectional view of the second embodiment of FIG. 8, taken substantially as shown by Section Line 10—10 of FIG. 8, and showing a second and narrower width of the center-panel ring.

Referring now to FIGS. 8–10, a container closure, or metal closure, 130 includes like-named and like-numbered parts as given in conjunction with the shell 12 of FIG. 2, except as will be described below.

The container closure 130 includes a connecting portion, or center-panel ring, 132 that is variegated in width. The connecting portion 132 includes a first and wider width 134, as shown in FIG. 9, and a second and narrower width 136, as shown in FIG. 10.

Thus, an inner portion, or center panel, 138 includes a perimeter 140 that deviates from being circular as a function of the variegations in width of the connecting portion 132. In like manner, an outer portion, or inner leg, 142 includes vaiegations in height from a shorter height 144 of FIG. 9 to a taller height 146 of FIG. 10.

The connecting portion 132 is formed at an angle 148 at the circumferential location wherein FIG. 9 is taken; and the connecting portion 132 is formed at an angle 150 at the circumferential location wherein FIG. 10 is taken. The angle 150 may be the same as the angle 148, less than the angle 148, or more than the angle 148. That is, the circumferential variegations may include the angles 148 and 150.

Preferably, a thickness 152 of the connecting portion 132 approximates the stock thickness 45. However, circumferential variegations may be made in the thickness 152, preferably by coining.

In summary, the circumferentially-variegated strengthening of the present invention, as taught above, selectively includes: circular coining that is circumferentially variegated, non-circular coining with one or more arcuate segments, variegated circumferential spacing between segments and/or variegated arcuate length of segments, variegated coin angles, variegated coin residuals, curvilinear coining with variegated curvatures or radii, circumferentially-variegated double coining, and variegated widths and angles of the connecting portion.

The method of the present invention includes forming a shell 12 substantially as shown in FIG. 2, except without the doming of the center panel 14, and subsequently reworking a portion of the shell 12, that generally follows the contour of the perimeter 20 of the center panel 14, that generally includes a portion of the center-panel ring 22, that may include a portion of the center panel 14, and that may include a portion of the inner leg 28, as shown in FIGS. 1 and 3–10.

Optionally, the method of the present invention comprises forming the metal closure 130 complete with circumferential variegations, without using an extra forming step.

Preferably, the circumferntial variegations are symmetrical around the pull-tab axis 48; because, the primary reason for the circumferential variegations is to compensate for extra metal in the center panel that is caused by scoring for the pull tab opening by selectively doming the center panel.

Referring again to FIG. 2, the selective doming produces a dome that varies from being a surface of revolution. That is, at a given radius 154 from the container axis 16, a product side 156, and a public side 158, of the container closure 10, 100, or 130 would be domed by a height 160 that is variegated as a function of circumferential position.

Further, this selective doming may produce a dome in which the maximum height 18 of the dome is non-axisymmetric with regard to the container axis. That is, the axis of the dome may be both spaced-apart from, and non-parallel to, the container axis 16, as shown by an axis 162 in FIG. 2.

The process of the present invention includes "cold-working" or "coining." As used herein, the term "cold-working" includes "coining;" but "coining" results in an appreciable reduction in stock thickness and the production of a coin residual.

It is common practice to form the shells 12 of FIG. 2 in a shell press which blanks and forms the basic shape from sheet metal stock. The partially completed shell 12 is then transferred to a conversion press where the opening features, as well as the rivet which holds the pull-tab opener 46, are formed.

The conversion press is a multi-station press. Each of the shells 12 is advanced progressively to new tooling wherein additional operations are performed. It is contemplated that as many as three cold-working, or coining, operations can be performed in the general area of the center-panel ring 14 to achieve the variegated strengthening that is taught herein, and that the resultant increase in buckling pressure will be greater than has resulted from prior art methods for increasing the buckling pressure of container closures by circumferentially-uniform coining.

A preferred material for the closures 10 is aluminum alloy 5182; although other aluminum alloys, and other metals, such as steel, may be used with the process described herein.

Preferably, the process is performed on a closure 10, 100, or 130 for attachment to a container having sidewalls.

While specific apparatus has been disclosed in the preceding description, it should be understood that these specifics have been given for the purpose of disclosing the principles of the present invention and that many variations thereof will become apparent to those who are versed in the art. Therefore, the scope of the present invention is to be determined by the appended claims.

Industrial Applicability

The present invention is applicable to metal closures for containers, and more particularly, the present invention is applicable to metal closures for containers, such as beverage containers.

What is claimed is:

1. A container closure which comprises:

an inner portion having a perimeter;

an outer portion being disposed perimetrically around said inner portion and being spaced outwardly therefrom;

a connecting portion being disposed perimetrically between said inner and outer portions and being integral with both of said portions; and circumferentially-variegated strengthening means, comprising a selected part of said closure that generally follows the contour of said perimeter, for strengthening said container closure.

2. A container closure as claimed in claim 1 in which said strengthening means comprises a circumferentially-variegated cross section.

3. A container closure as claimed in claim 1 in which said strengthening means comprises a circumferentially-variegated thickness.

4. A container closure as claimed in claim 1 in which said strengthening means comprises a circumferentially-variegated width of said connecting portion.

5. A container closure as claimed in claim 1 in which said selected part comprises a circumferentially-variegated width.

6. A container closure as claimed in claim 1 in which said container closure includes a public side and a product side;

said strengthening means comprises a coined surface that extends around a portion of said perimeter and that is circumferentially variegated.

7. A container closure as claimed in claim 1 in which said strengthening means comprises cold-worked portions of said closure that are generally arcuately-shaped and that are circumferentially spaced-apart.

8. A container closure as claimed in claim 1 in which said strengthening means comprises cold-worked portions of said closure that are generally arcuately-shaped, that are circumferentially spaced-apart, and that are circumferentially variegated in arcuate length.

9. A container closure as claimed in claim 1 in which said strengthening means comprises cold-worked portions of said closure that are generally arcuately-shaped, that are circumferentially spaced-apart, and that are circumferentially variegated in circumferential spacing.

10. A container closure as claimed in claim 1 in which said closure includes a public side and product side; and said strengthening means comprises a circumferentially-variegated surface of said public side.

11. A container closure as claimed in claim 1 in which said closure includes a public side and a product side; and said strengthening means comprises a circumferentially-variegated surface on said product side.

12. A container closure which comprise:

a center panel having a circular perimeter;

an inner leg being disposed perimetrically around said center panel and being spaced outwardly therefrom;

a center-panel ring being disposed perimetrically between said center panel and said inner leg and being integral with both said center panel and said inner leg; and circumferentially-variegated strengthening means, comprising a selected portion of said closure that generally follows the contour of said perimeter, for strengthening said container closure.

13. A container closure as claimed in claim 12 in which said strengthening means comprises a coined surface and variegated coin residuals.

14. A container closure as claim 12 in which said strengthening means comprises a coined surface and variegated coin angles.

15. A container closure as claimed in claim 12 in which said strengthening means comprises a curvilinear-coined surface of said center-panel ring.

16. A container closure as claimed in claim 12 in which said strengthening means comprises a curvilinear coined surface of said center-panel ring and variegated coin radii.

17. A container closure as claimed in claim 12 in which said strenthening means, and said selected portion thereof, comprises a first cold-worked area; and said strengthening means further comprises a second cold-worked area that includes a portion of said first cold-worked area, which has been twice cold-worked.

18. A container closure as claimed in claim 12 in which said strengthening means, and said selected area thereof, comprises a cold-worked portion of said center-panel ring.

19. A container closure as claimed in claim 12 in which said strengthening means, and said selected portion thereof, comprises a cold-worked portion of said closure that is adjacent to said center-panel ring.

20. A container closure as claimed in claim 12 in which said strengthening means, and said selected portion thereof, comprises a first cold-worked portion of said center-panel ring, and a second cold-worked portion of said closure that is adjacent to said center-panel ring.

21. A container closure as claimed in claim 12 in which said container closure includes a pull tab that is disposed generally along a pull tab axis; and said strengthening means comprises variegations, that are generally symmetrical to said pull tab axis.

22. A container closure as claimed in claim 12 in which said container closure includes a public side and a product side; and said strengthening means comprises a coined surface on one side of said container that includes a circumferentially-variegated width.

23. A metal closure which comprises:

a center panel having a circular perimeter;

an inner leg being disposed perimetrically around said center panel and being spaced outwardly therefrom;

a center-panel ring being disposed perimetrically between said center panel and said inner leg and being integral with both said center panel and said inner leg; and strengthening means, comprising a cold-worked portion of said closure generally follows the contour of said perimeter and that is non-circumferential, for strengthening said metal closure.

24. A metal closure as claimed in claim 23 in which said cold-worked portion comprises first and second cold-worked areas that are circumferentially spaced-apart.

25. A metal closure as claimed in claim 23 in which said cold-worked portion includes a circumferentially-variegated thickness.

26. A metal closure as claimed in claim 23 in which said cold-worked portion includes a circumferentially-variegated width.

27. A metal closure which comprises:

a center panel having a perimeter;

an inner leg being disposed perimetrically around said center panel and being spaced outwardly therefrom; and circumferentially-variegated connecting means, being disposed perimetrically between said center panel and said inner leg, including circumferential variegations, for connecting said inner leg to said center panel, and for strengthening said center panel by said circumferential variegations.

28. A metal closure as claimed in claim 27 in which said metal closure comprises a public side and a product side; and said circumferential variegations comprise circumferential variegations in the surfaces of one of said sides.

29. A metal closure as claimed in claim 27 in which said circumferential variegations comprise circumferential variegations in thickness of said connecting means.

30. A metal closure as claimed in claim 27 in which said circumferential variegations comprise circumferential variegations in the width of said connecting means.

31. A metal closure as claimed in claim 27 in which said circumferential variegations comprise circumferential variegations in the height of said inner leg.

32. A metal closure which comprises:

a circular center panel being disposed orthogonal to a container axis, and having a circular perimeter;

a circular inner leg being disposed perimetrically around said center panel, and being spaced apart therefrom;

a center-panel ring being disposed perimetrically around said center panel, being interposed between said center panel and said inner leg, curving from said center panel to said inner leg, and being integral with said center panel and said inner leg; and doming means, comprising a plurality of cold-worked areas of said closure that are arcuately-shaped and that are circumferentially spaced-apart around said container axis, for selectively doming said center panel.

33. A metal closure as claimed in claim 32 in which one of said cold-worked areas has a first arcuate length; and another of said cold-worked areas has a second and longer arcuate length.

34. A metal closure as claimed in claim 32 in which two of said cold-worked areas are circumferentially spaced-apart from each other by a first distance; and a third of said cold-worked areas is circumferentially spaced-apart from one of said cold-worked areas by a second and smaller distance.

35. A method for making a metal closure having increased strength, which method comprises:

(a) forming a center panel with a perimeter;

(b) forming an inner leg that is disposed perimetrically around said center panel and that is spaced-apart therefrom; and (c) forming a circumferentially-variegated connecting portion that is disposed perimetrically between said center panel and said inner leg and that is integral therewith.

36. A method as claimed in claim 35 in which said metal closure includes a public side and a product side; and said step of forming a circumferentially-variegated connecting portion comprises forming circumferential variegations in the surfaces of one of said sides.

37. A method as claimed in claim 35 in which said step of forming a circumferentially-variegated connecting portion comprises forming circumferential variegations in the thickness of said connecting portion.

38. A method as claimed in claim 35 in which said step of forming a circumferentially-variegated connecting portion comprises forming said connecting portin with circumferentially-variegated widths.

39. A method as claimed in claim 35 in which said forming of said inner leg comprises forming said inner leg with a circumferentially-variegated height.

40. A method for making a metal closure having increased strength, which method comprises:

(a) forming an inner portion with a perimeter;

(b) forming an outer portion that is disposed perimetrically around said inner portion and that is spaced-apart therefrom;

(c) forming a connecting portion that is disposed perimetrically between said inner and outer portions and that is integral therewith; and (d) strengthening said inner portion by forming circumferential variegations in a selected portion of said container closure that generally follows the contour of said perimeter.

41. A method as claimed in claim 40 in which said strengthening step comprises coining said selected portion to variegated coin angles.

42. A method as claimed in claim 40 in which said strengthening step comprises coining said selected portion to variegated coin residuals.

43. A method as claimed in claim 40 in which said selected portion comprises a part of said connecting portion.

44. A method as claimed in claim 40 in which said selected portion comprises a part of said metal closure that is adjacent to said connecting portion.

45. A method for making a metal closure having increased strength, which method comprises:

(a) forming a center panel that is disposed orthogonally to a container axis;

(b) forming an inner leg that is disposed perimetrically around said center panel and that is spaced-apart therefrom;

(c) forming a center-panel ring that is disposed perimetrically around said center panel, that is disposed intermediate of said center panel and said inner leg, and that is integral with both said center panel and said inner leg; and (d) strengthening said center panel by cold-working a selected portion of said metal closure that generally follows said perimeter and that is non-circumferential.

46. A method as claimed in claim 45 which said cold-working of said selected portion comprises cold-working first and second arcuately-shaped areas; and said first and second arcuately-shaped areas have variegated arcuate lengths.

47. A method as claimed in claim 45 in which said cold-working of said selected portion comprises cold-working first, second, and third arcuately-shaped areas; and said arcuately-shaped areas are spaced-apart at variegated arcuate distances.

48. A method for making a metal closure having increased strength, which method comprises:

(a) forming a circular center panel that is disposed orthogonally to a container axis and that includes a perimeter that is coaxial with said container axis;

(b) forming a circular inner leg that is disposed circumferentially around said center panel and that is spaced-apart therefrom;

(c) forming a center-panel ring that is disposed circumferentially around said center panel and that is integral with both said center panel and said inner leg; and (d) selectively doming said center panel by cold-working a plurality of arcuately-shaped and circumferentially-spaced areas of said closure that generally follow the contour of said perimeter.

49. A container closure of the type having a perimeter and having a generally-planar portion inside said perimeter, the improvement which comprises:

means, comprising a variegated portion of said closure that generally follows the contour of said perimeter, for strengthening said closure.

50. A container closure of the type having a perimeter and having a generally-planar portion inside said perimeter, the improvement which comprises:

means, comprising a variegated portion of said closure that generally follows the contour of said perimeter and that is cold-worked, for strengthening said closure.

51. A container closure of the type having a perimeter and having a generally-planar porton inside said perimeter, the improvement which comprises:

means, comprising a variegated portion of said closure that generally follows the contour of said perimeter, for selectively doming said closure.

52. A method for forming a container closure with increased strength, which method comprises:

(a) forming an outer perimeter;

(b) forming a center panel inside said outer perimeter; and (c) forming a variegated portion intermediate of said outer perimeter and said center-panel portion that generally follows said perimeter.

53. A method for selectively doming a container closure of the type having a perimeter, which method comprises:

cold-working a variegated portion of said container that generally follows said perimeter.

* * * * *